US010290449B2

(12) United States Patent
Balgheim et al.

(10) Patent No.: US 10,290,449 B2
(45) Date of Patent: May 14, 2019

(54) ELECTRIC SWITCH

(71) Applicant: JOHNSON ELECTRIC INTERNATIONAL AG, Murten (CH)

(72) Inventors: Udo Balgheim, Hueckeswagen (DE); Gerhard Fangmann, Marienheide (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 15/711,791

(22) Filed: Sep. 21, 2017

(65) Prior Publication Data

US 2018/0082815 A1 Mar. 22, 2018

(30) Foreign Application Priority Data

Sep. 21, 2016 (DE) ..... 10 2016 117 782

(51) Int. Cl.

| | |
|---|---|
| ***H01H 9/20*** | (2006.01) |
| ***H01H 51/01*** | (2006.01) |
| ***H01F 7/122*** | (2006.01) |
| ***H01F 7/124*** | (2006.01) |
| ***H01F 7/16*** | (2006.01) |
| ***H01F 7/14*** | (2006.01) |

(52) U.S. Cl.

CPC ..... *H01H 51/01* (2013.01); *H01F 7/122* (2013.01); *H01F 7/124* (2013.01); *H01F 7/14* (2013.01); *H01F 7/1646* (2013.01)

(58) Field of Classification Search

CPC ..... H01H 50/32–50/34

USPC ..... 335/167–171

See application file for complete search history.

(56) References Cited

U.S. PATENT DOCUMENTS

| | | | | |
|---|---|---|---|---|
| 3,525,960 | A * | 8/1970 | Robbins | H01H 51/088 200/562 |
| 4,378,543 | A * | 3/1983 | Melter | H01H 50/326 335/166 |
| 6,954,125 | B2 * | 10/2005 | Wu | H01H 83/04 335/18 |
| 9,036,320 | B1 * | 5/2015 | Elberbaum | H01H 47/22 361/160 |
| 9,257,251 | B2 * | 2/2016 | Elberbaum | H01H 51/27 |
| 9,281,147 | B2 * | 3/2016 | Elberbaum | H01H 51/27 |
| 2015/0279599 | A1 * | 10/2015 | Kuo | H01H 9/24 335/168 |
| 2015/0311020 | A1 * | 10/2015 | Elberbaum | H01H 51/27 335/168 |

* cited by examiner

*Primary Examiner* — Alexander Talpalatski

(74) *Attorney, Agent, or Firm* — Muncy, Geissler, Olds & Lowe, P.C.

(57) ABSTRACT

An electric switch is provided. The electric switch comprises a contact system, an actuation element, an engaging latch, and an actuator. The actuation element moves between an initial position and an actuation position to switch and changeover the contact system. The actuation element is located in a direction of the initial position by a force of a return spring. The engaging latch locks the actuation element in the initial position or the actuation position. A non-manual unlocking between the actuation element and the engaging latch is performed by the actuator.

12 Claims, 3 Drawing Sheets

ELECTRIC SWITCH

CROSS REFERENCE TO RELATED APPLICATIONS

This non-provisional patent application claims priority under 35 U.S.C. § 119(a) from Patent Application No. 10 2016 117 782.2 filed in Germany on Sep. 21, 2016.

TECHNICAL FIELD

The present disclosure relates to an electric switch for electric devices which can be shutdown manually and automatically.

BACKGROUND

Electric devices consume energy for a variety of functions. Such devices must comply with requirements of European Parliament Directive 2009/125/EG dated 21 Oct. 2009 which establishes a framework for setting mandatory ecological requirements for energy-related products. For this reason, automatic shutdown mechanisms are to be provided for a variety of electric devices, so that a shutdown takes place, for example, by means of external signals or the devices' own electronic control system with different stages. Such a shutdown particularly relates to a stage with highest energy consumption, the so-called max setting. In exhaust hoods, for example, several switches are used, namely one switch for switching on a light source and several switches for switching to various exhausting rates. In known devices, the highest exhausting rate is controlled by means of relays having timers and electronics. A design of this kind is complex and expensive. However, cost-effective devices can only be switched on and off manually.

SUMMARY

In view of the above, an electric switch for automatically shutting down electric devices which is simple in construction and has a small design profile is provided.

The electric switch of the present disclosure includes a housing. A contact system is provided in the housing. The contact system can be switched by an actuation element, such as, an axially displaceable plunger. The actuation element can move between two positions, namely an initial position and an actuation position. The actuation element is loaded to return in a direction of the initial position by a return spring. The actuation element acts on the contact system.

In a simple design, the contact system can include a fixed contact and a movable contact.

In another embodiment, a plurality of pairs of contacts can be provided and a changeover can be acted by the actuation element.

After an actuation of the actuation element, the actuation element remains in the actuation position by engaging with an engaging latch. The engaging latch includes a hook arranged in one end. The hook can engage with a guiding curve of a heart-shaped switching groove arranged on the actuating element, meaning that it engages into the guiding curve of the heart-shaped switching groove, whereby the actuating element is locked in particular into its actuation position, and the desired contact continues to be maintained. One further actuation of the actuation element causes the engaging latch, via the action of the return spring, to move back along the guiding curve of the heart-shaped switch into the initial position.

In addition to such manual unlocking, non-manual unlocking is also provided in the electric switch according to the disclosure. The electric switch includes an actuator for unlocking the engaging latch, the act of which interrupts the existing contact. The movable actuator acts on the engaging latch, meaning that movement of the actuator causes the engaging latch to unlock.

In an advantageous embodiment, the actuator is a pivotable element comprising a shaft that is retained on the housing. The pivotable element includes a retaining pocket for the permanent magnet, preferably adjacent to a pivot axis. If the permanent magnet is located in the retaining pocket on the actuator, then a movement path of the permanent magnet is predetermined by the potential pivotal movement of the actuator about the pivotal axis. Magnetic material or a permanent magnet or several permanent magnets can also be embedded into the plastic material of the actuator.

A cam is furthermore provided on the actuator according to the preferential embodiment for the purpose of influencing the actuator on the engaging latch. The cam projects from the shaft and located beneath the engaging latch when the actuator is in a neutral position so that the engaging latch lies within the movement path of the cam and, a pivotal movement of the actuator, the latch can be lifted out of the guiding curve of the heart-shaped switching groove.

For non-manual unlocking, the actuator is moved by a controllable drive mechanism. This controllable drive mechanism is a coil and the aforementioned permanent magnet. The coil does not include an armature. Without a drive, during a normal operation of the electric device or while the electric device is switched off, the permanent magnet, by virtue of its magnetic properties, is attracted by an iron core of the coil because the iron core of the coil is made of an analogous ferromagnetic material. Consequently, without a drive, the permanent magnet and iron core of the coil form a uniform magnetic circuit. This state consumes no any energy. If the coil is driven, this means that current flows through the coil for a short time. A magnetic field is induced in the coil. This magnetic field is oriented opposite to the magnetic field of the permanent magnet, which leads to a repulsion of the permanent magnet. This impulsive repulsion is used to move the actuator, meaning that a driving impulse of the permanent magnet is transmitted to the actuator so that the movement of the actuator is resulted, thus non-manual unlocking of the engaging latch from the heart-shaped switching groove is acted.

In a simple embodiment, the permanent magnet is located apart from the actuator, namely between the coil and the actuator. In such an arrangement, a guide for the movement path of the magnet is provided on the housing side. Since a current for short-time in the coil causes the magnet to be attracted to the coil, thus the magnet is moved back to the initial position, there occurs a sort of self-positioning of the magnet on the coil.

In an advantageous embodiment, a control unit is provided in the switch for controlling non-manual unlocking. The control unit comprises a timer function so that the drive mechanism is controlled according to a time period stored in the control unit, meaning that current flows for a short time to the coil in a predetermined time period. For electric devices having control unit outside of the switch, the signal can also be transmitted from outside via an external interface with the switch. In a further embodiment, a receiver is provided in the switch for receiving external shutdown signals.

The novel electric switch according to the disclosure described herein is of simple design. A very small coil can be used for a switch of this kind because no armature actuator needs to be moved by this coil. Advantageously, this is a decoupled system because the contactor is independent of the trigger mechanism. Switches of this kind can be used for all electric devices in which shutdown or changeover is intended to take place following a predetermined time period.

Figure 1:
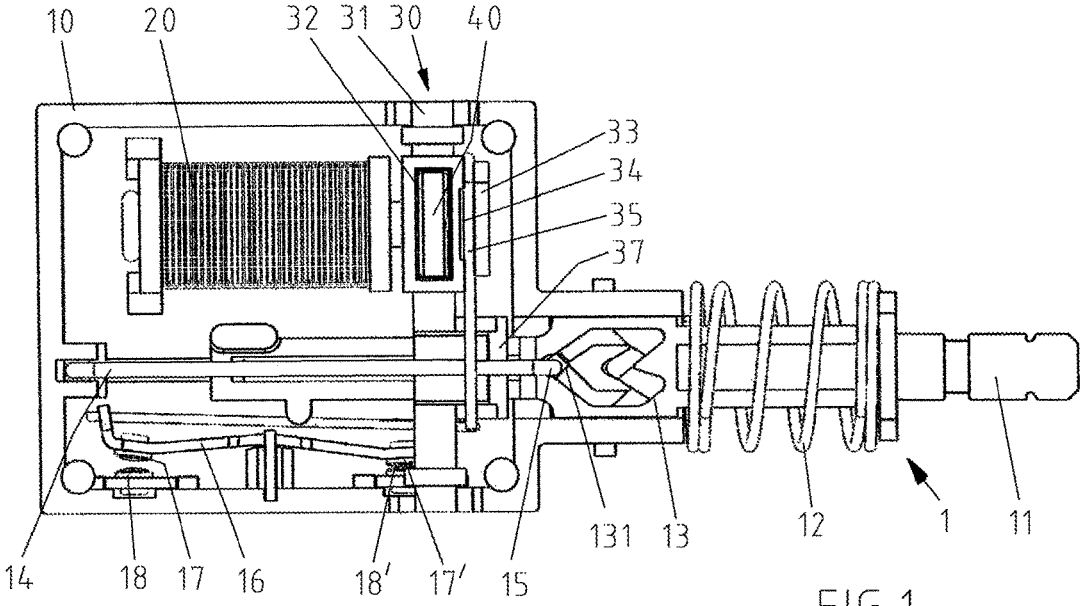
FIG. 1 is a plan view of the electric switch in an initial position without a housing-side cover.

The following implementations are used for the description of the present disclosure in conjunction with above figures.

DETAILED DESCRIPTION OF THE EMBODIMENTS

Hereinafter technical solutions in embodiments of the present disclosure are described clearly and completely in conjunction with the drawings in embodiments of the present disclosure. Apparently, the described embodiments are only some rather than all of the embodiments of the present disclosure. Any other embodiments obtained based on the embodiments of the present disclosure by those skilled in the art without any creative work fall within the scope of protection of the present disclosure. It is understood that the drawings are only intended to provide reference and illustration, and not to limit the present disclosure. The connections in the drawings are only intended for the clearance of description, and not to limit the type of connections.

It should be noted that, if a component is described to be "connected" to another component, it may be connected to another component directly, or there may be an intervening component simultaneously. All the technical and scientific terms in the present disclosure have the same definitions as the general understanding of those skilled in the art, unless otherwise defined. Herein the terms in the present disclosure are only intended to describe embodiments, and not to limit the present disclosure.

Figure 2:
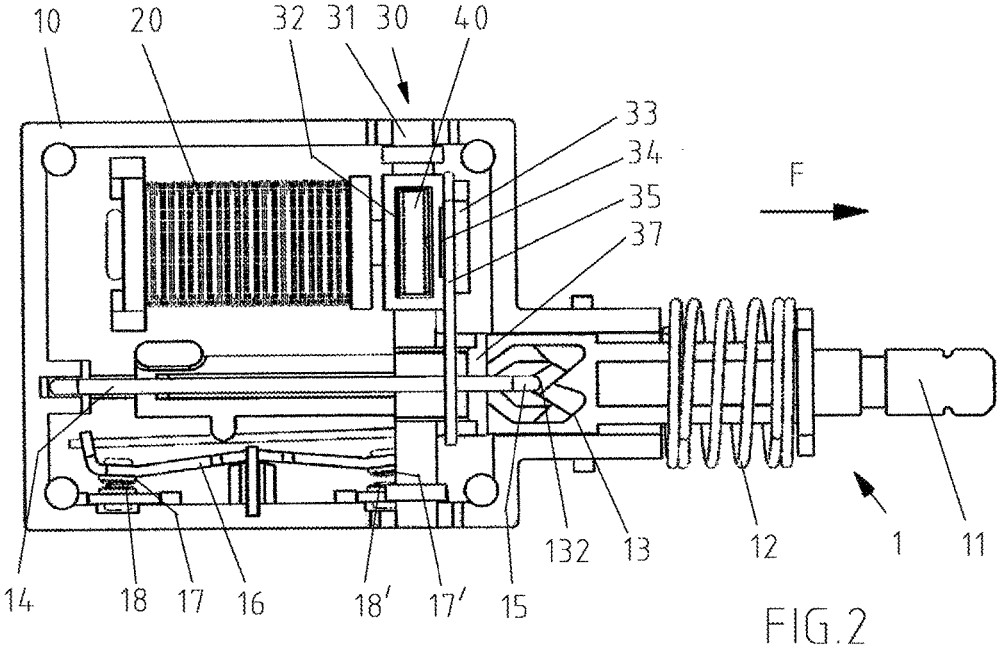
FIG. 2 is the switch of FIG. 1 in an actuation position.

FIGS. 1 to 3 show a possible embodiment of an electric switch 1 according to the present disclosure, which can be used, for example, for exhaust hoods, but which can as well be used for other electric devices in which non-manual unlocking of the actuating element 11 is intended to take place.

The electric switch in FIG. 1 is shown in an initial position. To provide a better overview, the housing 10 is illustrated without a cover. The actuation element 11 is a linearly movable plunger, which is displaceable between the initial position shown in FIG. 1 and an actuation position shown in FIG. 2. When the plunger 11 is actuated, the plunger 11 is pressed into the housing 10 against a force F of a return spring 12. In this actuation, a hook 15 of an engaging latch 14 moves along a guiding curve of a heart-shaped switching groove 13 arranged on the plunger 11, meaning that the hook 15 moves from a position 131 (shown in FIG. 1) into a position 132 (shown in FIG. 2). By virtue of being locked by the engaging latch 14, the actuating element 11 remains in the actuation position.

The electric switch of this kind can be used to switch on and off, and can also be used as a changeover switch. The present embodiment is a changeover switch. As can be seen from FIG. 1, the actuation element 11, namely the plunger, acts on a contact rocker 16. In this case, two contacts 17, 17' are provided on the contact rocker 16, namely each on one end of a contact arm. These two contacts 17, 17' each interact with a fixed contact 18, 18' provided on the housing 10. In the initial position (shown in FIG. 1), the contact surface 17' contacts the fixed contact 18'. The contact 17, which is arranged at opposite on the contact rocker 16, is arranged at a distance from fixed contact 18. A changeover occurs by actuation of the plunger 11 (see FIG. 2). After actuation, the other contact 17 contacts the fixed contact 18, and the contact between contacts 17' and 18' is released. If the actuation element, namely the plunger 11, is located in the actuation position (shown in FIG. 2) and this plunger 11 is pressed once again, the changeover occurs once again.

When the plunger 11 is actuated once more, the hook 15 of the engaging latch 14 moves in a known manner along the guiding curve of the heart-shaped switching groove 13 and back into position 131, which is the initial position. The end of the engaging latch 14 opposite the hook 15 is retained on the housing 10. Movement within the heart-shaped switching groove 13 is ensured by a correspondingly flexible construction of the engaging latch 14.

In addition to the manual unlocking of the engaging latch 14 by means of actuating the plunger 11 once again as described above, non-manual locking is also possible. For non-manual unlocking, the electric switch 1 includes an actuator 30, which acts on the engaging latch 14 and can be moved by a controllable drive mechanism. The controllable drive mechanism is a coil 20 and a permanent magnet 40. The coil 20 is a small coil and does not include an armature. A permanent magnet 40 is provided at the end of the coil 20. Due to its magnetic properties, this permanent magnet 40 is attracted by the coil 20, that is, the coil 20 and the permanent magnet 40 create a uniform magnetic field without any influence. Such a uniform magnetic field exists both in the initial position (FIG. 1) and in the actuation position (FIG. 2).

Figure 3A:
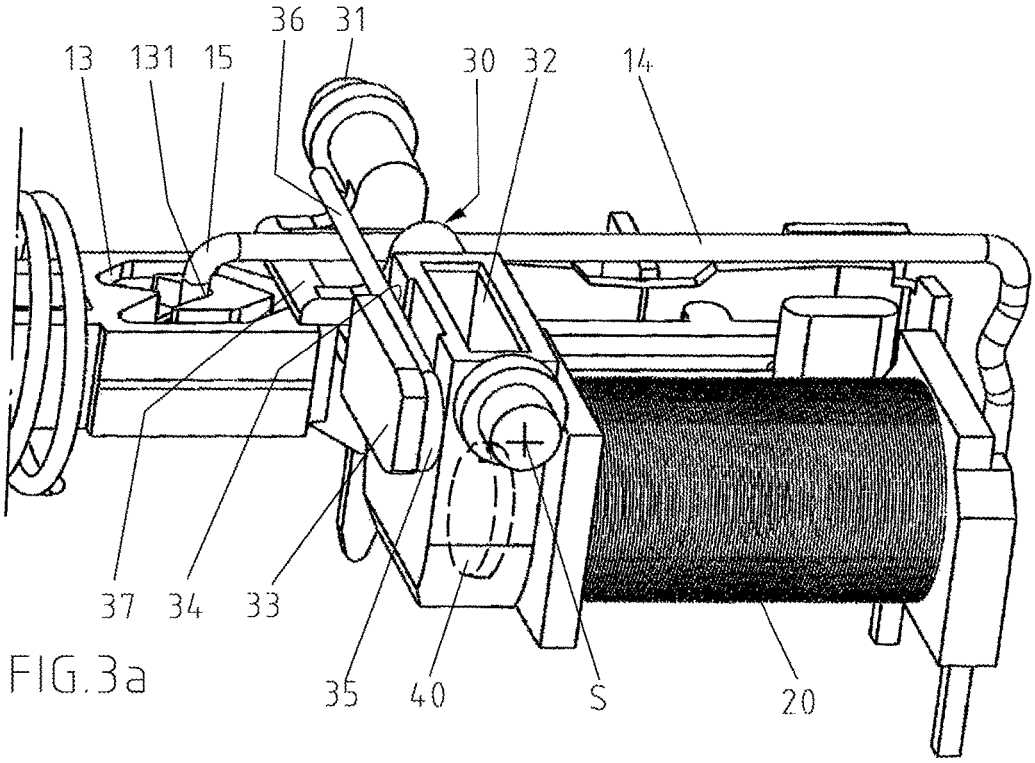
FIGS. 3*a*-3*d* are the individual phases of unlocking the switch of FIG. 1, shown without the housing.

If such an electric switch is installed in an electric device, for example in an exhaust hood and the max power level is used for vapor extraction, then the actuation position will be according to FIG. 3*a*. Changeover takes place when extraction at the max power level has consumed the maximum allowable amount of energy. The maximum allowable energy consumption can, for example, be a predetermined time period entered into control unit and determined by a timer.

Figure 3B:
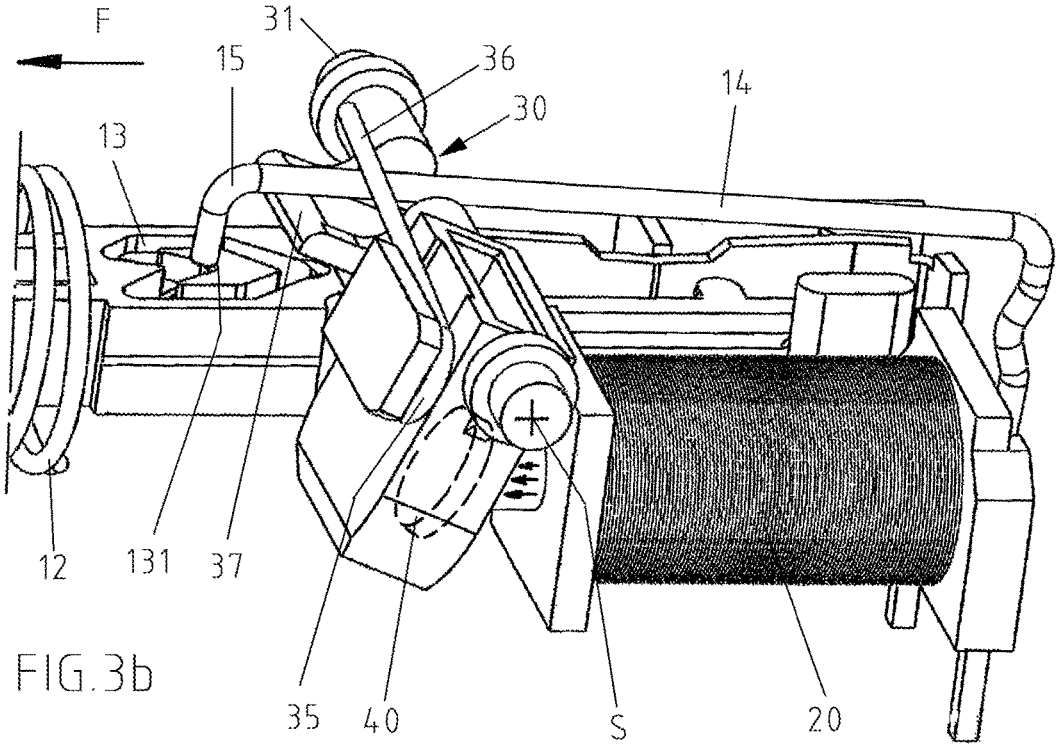
Figure 3C:
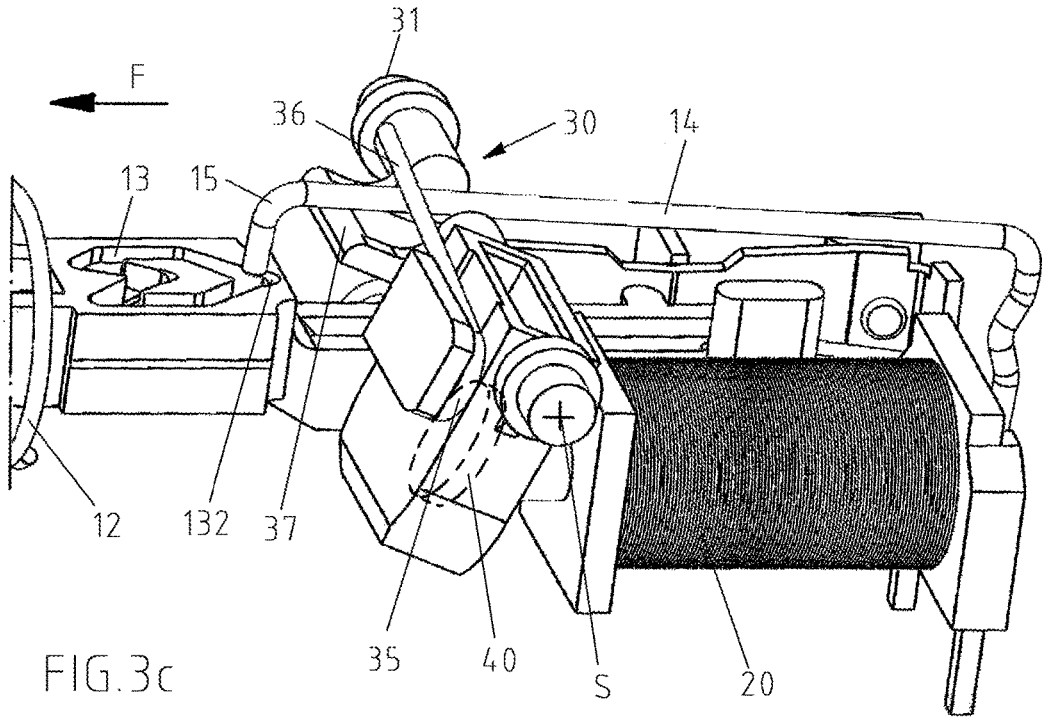
Figure 3D:
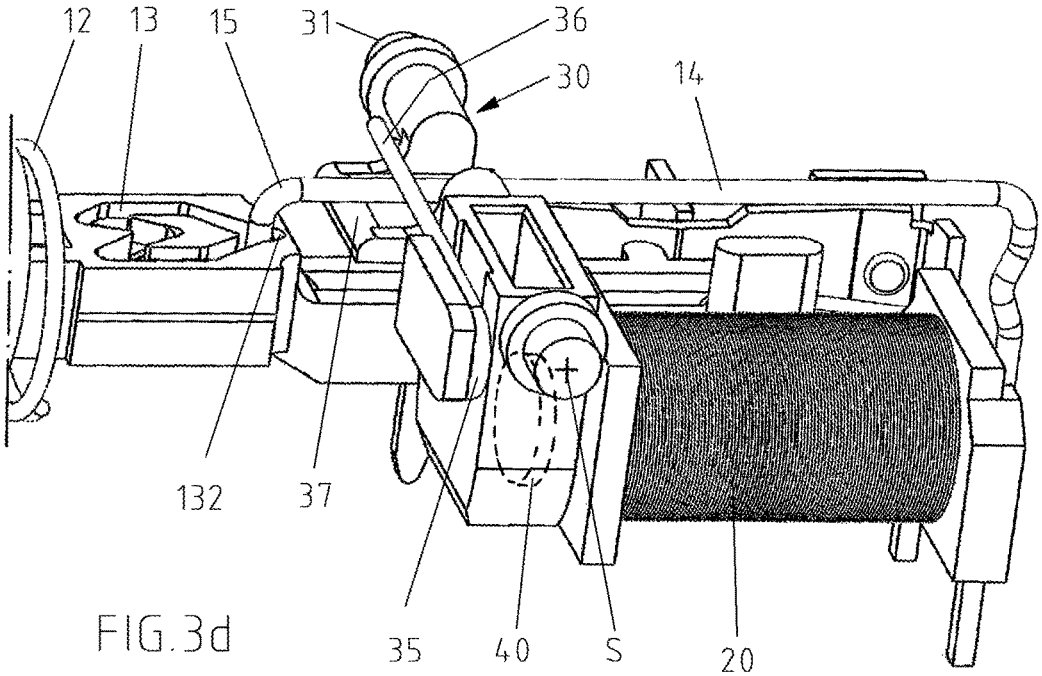

After the determined time period has passed, a control input occurs, meaning that a current flows for a short time through the coil 20. Due to the current, a magnetic field is induced in the coil 20. It is thereby provided that this magnetic field is oriented opposite to the magnetic field of the permanent magnet 40 so that the permanent magnet 40 is repelled by the magnetic field induced by the coil 20. This is shown in FIG. 3*b*, and the repulsive force is indicated by the three arrows. Since the permanent magnet 40, which is in this case a round magnetic disk, is located in a retaining pocket 32 of the actuator 30 and is namely arranged adjacent to a pivot axis S of the actuator 30, this repulsion of the permanent magnet 40 causes a driving force to be transmitted to the actuator 30.

The actuator 30 moves about the pivot axis S, which is defined by the shaft 31 of the actuator 30. As can be best understood from FIGS. 1 and 2, the shaft 31 is pivotably retained in the housing 10. Furthermore, a cam 37 is located on the shaft 31, and the cam 37 projects from the shaft 31 and is located beneath the engaging latch 14 both in the initial position and (as shown in FIG. 3*a*) the actuation position of the actuation element 11. The engaging latch 14 is thus located in front of the cam 37 and is arranged within the movement curve of the cam 37. When a flow of current flows through the coil 20 and the resulting repulsion of the permanent magnet 40, which results in a pivoting movement of the actuator 30 and the cam 37, causes the engaging latch 14 to be raised, thus lifting the hook 15 of the engaging latch 14 from its guiding curve in the heart-shaped switching groove 13, namely out of position 131.

After the hook 15 is lifted out of the guiding curve (shown in FIG. 3*b*), the actuation element 11 is unlocked and, due to the spring force F of the return spring 12, moves back into the initial position. This return movement of the plunger 11 changes the position of the hook 15 in relation to the guiding curve of the heart-shaped switching groove 13 (shown in FIG. 3*c*). The hook 15 is then located above position 132. Since the flow of current through the coil 20 is only a short time, meaning that the permanent magnet 40 experiences only a short time driving force and is subsequently once again attracted by the coil 20, thus forming a uniform magnetic field together with the coil 20 (shown in FIG. 3*d*), the actuator 30 also moves back again along with the permanent magnet 40.

During this process, the hook 15 of the engaging latch 14 is again pushed back into the guiding curve of the heart-shaped switching groove 13. This is assisted by means of a bow spring 35, which is arranged on the actuator 30, namely on a hub 33 provided adjacent to the shaft 31. The hub 33 can include a groove 34 for receiving the bow spring 35. A free end 36 of the bow spring 35 lies against the engaging latch 14. A force of the bow spring 35 pushes the hook 15 downward into the guiding curve of the heart-shaped switching groove 13.

The example described here by way of FIGS. 3*a* to 3*d* can also work in reverse so that, absent control input, the coil 20, which has current flowing through it, possesses its own magnetic field, which acts to repel the permanent magnet 40 and, given control input, the permanent magnet 40 will be attracted by the coil 20, thus causing movement of the actuator 30.

Described above are exemplary embodiments of the present disclosure, which are not intended to limit the present disclosure. All the modifications, replacements and improvements in the scope of the concepts and principles of the present disclosure are in the scope of the protection thereof.

The invention claimed is:

1. An electric switch, comprising:

a housing;

a contact system;

an actuation element moving between an initial position and an actuating position for switching or changeover the contacting system;

the actuation element located in a direction of the initial position by a force of a return spring;

an engaging latch interacting with a guiding curve of a heart-shaped switching groove arranged on the actuation element to make the actuation element locked in the actuation position;

an actuator driving a non-manual unlocking of the actuation element on the engaging latch under control a drive mechanism;

wherein the drive mechanism comprises a coil and a permanent magnet, when the coil is not driven, the permanent magnet is attracted by the coil and a uniform magnetic circuit is formed between the permanent magnet and the coil; when a current flows through the coil, a magnetic field is generated to repel the permanent magnet to dive the actuation element.

2. The electric switch of claim 1, wherein the actuator comprises a shaft which is retained on the housing, and the permanent magnet is retained in a retaining pocket on the actuator and arranged adjacent to a pivot axis of the actuator.

3. The electric switch of claim 2, wherein a cam is located at an end of the shaft of the actuator, and the engaging latch is located within a movement curve of the cam, and the cam is capable of lifting the engaging latch out of the guiding curve of the heart-shaped switching groove.

4. The electric switch of claim 3, wherein a bow spring retained on the actuator, and a free spring arm of the bow spring pushes against the engaging latch, and a hook on an end of the engaging latch engages with the guiding curve of the heart-shaped switching groove.

5. The electric switch of claim 1, wherein magnetic material of at least one permanent magnet is embedded into plastic material of the actuator.

6. The electric switch of claim 1, wherein a control unit is provided in the housing and the control unit comprises a timer to set a maximum allowable amount of energy with a predetermined time period.

7. The electric switch of claim 6, wherein the control unit receives a shutdown signal via an external interface on the switch.

8. The electric switch of claim 7, wherein the control unit comprises a receiver, and the receiver is configured to receive the shutdown signal; the drive mechanism is controlled by the shutdown signal.

9. The electric switch of claim 8, wherein the actuation element is a plunger which acts on a contact rocker, and the contact rocker comprises at least one contact surface.

10. The electric switch of claim 9, wherein the contact rocker is held at a distance from a fixed contact in the initial position of the actuation element; a contact between the contact surface and the fixed contact is made by a movement of the actuation element.

11. The electric switch of claim 9, wherein the contact rocker comprises a contact surface on its one arm, and the contact surface contacts with a fixed contact in the initial position of the actuation element; and an additional contact surface is arranged on the other arm of the contact rocker, the additional contact surface is held at a distance from an additional fixed contact, a contact between the additional contact surface and an additional fixed contact is made by a movement of the actuation element.

12. An electric switch, comprising:

a housing;

a contact system;

an actuation element moving between an initial position and an actuating position for switching the contact system;

the actuation element loaded in a direction of the initial position by a force of a return spring;

an engaging latch interacting with a guiding curve of a heart-shaped switching groove arranged on the actuation element, and the actuation element driven to be locked in the actuation position;

an actuator driving a mon-manual locking of the actuation element on the engaging latch under control a drive mechanism;

wherein the drive mechanism comprises a coil and a permanent magnet, when a current flows through the coil, a magnetic field is generated to repel the permanent magnet, the permanent magnet is attracted by the coil to drive the actuator to move.

* * * * *